US007287387B2

(12) United States Patent
Kirichek et al.

(10) Patent No.: US 7,287,387 B2
(45) Date of Patent: Oct. 30, 2007

(54) COOLING APPARATUS

(75) Inventors: Oleg Kirichek, Oxon (GB); Milind Diwakar Atrey, Oxon (GB); Christopher Johnson, Oxford (GB); Mir Fattah Hodaei, Oxon (GB)

(73) Assignee: Oxford Instruments Superconductivity Ltd, Oxon (GB)

( * ) Notice: Subject to any disclaimer, the term of this patent is extended or adjusted under 35 U.S.C. 154(b) by 321 days.

(21) Appl. No.: 10/960,279

(22) Filed: Oct. 8, 2004

(65) Prior Publication Data

US 2005/0229620 A1 Oct. 20, 2005

(30) Foreign Application Priority Data

Apr. 15, 2004 (GB) ..... 0408425.7

(51) Int. Cl.
*F25B 9/00* (2006.01)
*F25D 19/00* (2006.01)

(52) U.S. Cl. ..... 62/6; 62/295

(58) Field of Classification Search ..... 62/6, 62/295

See application file for complete search history.

(56) References Cited

U.S. PATENT DOCUMENTS

| | | | | |
|---|---|---|---|---|
| 2,352,038 | A | 6/1944 | Tölke | |
| 2,565,296 | A | 8/1951 | Chyle | |
| 4,535,595 | A | 8/1985 | Keller et al. | |
| 4,765,153 | A | 8/1988 | Wachi | |
| 4,777,807 | A | 10/1988 | White | |
| 4,862,697 | A | 9/1989 | Tugal et al. | |
| 4,986,077 | A | 1/1991 | Saho et al. | |
| 5,111,665 | A * | 5/1992 | Ackermann | 62/6 |
| 5,129,232 | A | 7/1992 | Minas et al. | |
| 5,176,003 | A | 1/1993 | Horikawa et al. | |
| 5,216,889 | A * | 6/1993 | Herd et al. | 62/51.1 |
| 5,247,800 | A | 9/1993 | Mruzek et al. | |
| 5,381,666 | A | 1/1995 | Saho et al. | |
| 5,430,423 | A | 7/1995 | Herd et al. | |
| 5,522,226 | A * | 6/1996 | Mruzek | 62/51.1 |
| 5,583,472 | A | 12/1996 | Moritsu et al. | |
| 5,638,685 | A | 6/1997 | Inaguchi et al. | |
| 5,682,751 | A | 11/1997 | Langhorn et al. | |
| 5,864,273 | A * | 1/1999 | Dean et al. | 335/216 |
| 5,884,489 | A * | 3/1999 | Retz et al. | 62/51.1 |
| 5,934,082 | A * | 8/1999 | Steinmeyer | 62/51.1 |
| 5,966,944 | A * | 10/1999 | Inoue et al. | 62/51.1 |
| 6,164,077 | A * | 12/2000 | Feger | 62/6 |
| 6,181,228 | B1 * | 1/2001 | Laskaris et al. | 335/300 |
| 6,990,818 | B2 * | 1/2006 | Hofmann | 62/6 |
| 2003/0106326 | A1 | 6/2003 | Yutaro et al. | |

FOREIGN PATENT DOCUMENTS

| | | |
|---|---|---|
| CH | 374255 | 12/1963 |
| EP | 0 350 266 A2 | 1/1990 |
| EP | 0 414 443 A1 | 2/1991 |
| EP | 1 279 886 A2 | 1/2003 |
| FR | 2 568 350 A1 | 1/1986 |
| WO | WO87/05990 | 10/1987 |

* cited by examiner

*Primary Examiner*—William C Doerrler

(57) ABSTRACT

Cooling apparatus comprises a vacuum chamber, an inner chamber positioned within the vacuum chamber adapted to contain a coolant for cooling target apparatus, and a mechanical refrigerator for refrigerating the coolant and having at least one cooled part in contact with the coolant.

Figure 1:
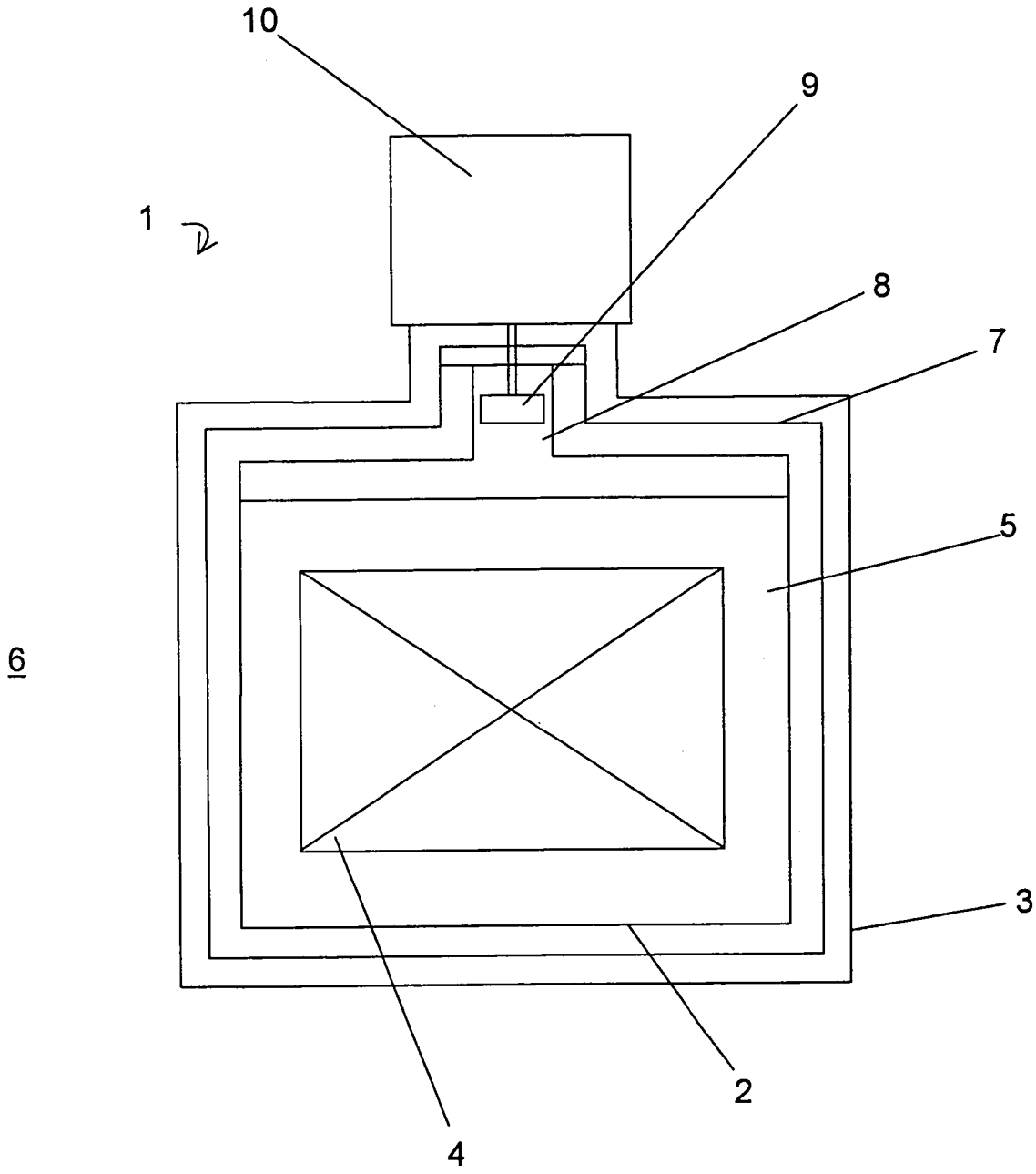

The mechanical refrigerator is coupled to one or each of the vacuum chamber and inner chamber through vibration-reducing couplings, so as to reduce the effect upon the target apparatus of vibrations from the mechanical refrigerator.

32 Claims, 2 Drawing Sheets

COOLING APPARATUS

The present invention relates to cooling apparatus for example for use in cooling superconducting magnets or other equipment.

In many low temperature applications, the low temperatures desired are provided by the use of a cryostat. This has an inner chamber which typically contains a coolant such as liquid helium normally at ambient pressure, surrounded by an outer chamber which is evacuated to provide good thermal insulation from the exterior environment. One or more radiation shields are also provided within the evacuated volume of the vacuum chamber so as to improve the thermal insulation performance. Typically such radiation shields are maintained at a low temperature which is intermediate between the temperatures of the coolant and the external environment.

Normally the coolant such as liquid helium is placed within the inner chamber and this gradually evaporates over time thereby giving the apparatus a limited operational lifetime before refilling with coolant as required. There has recently been an increased interest in adding mechanical refrigeration devices to cool the apparatus. This reduces the "boil off" of coolant, for example by providing a cooled low temperature recondenser (having an operational temperature below the coolant condensation temperature), this being placed in an outlet of the inner chamber. Whilst the provision of a recondenser provides for a marked increase in the time between coolant refilling operations, one major problem associated with the use of mechanical refrigerators to cool the apparatus is that vibrations propagate from them to the target apparatus being cooled.

The vibrations can manifest themselves in a number of ways such as a physical vibration of experimental samples, or indeed the vibration of other target apparatus interfering with magnetic fields. Each of these effects is extremely undesirable and must be addressed in order to allow the full benefits of cooled apparatus to be realised. This is a particular problem in high sensitivity nuclear magnetic resonance experiments.

In accordance with the invention, we provide cooling apparatus comprising:

- a vacuum chamber;
- an inner chamber positioned within the vacuum chamber and adapted in use to contain a coolant for cooling target apparatus; and
- a mechanical refrigerator for refrigerating the coolant and having at least one cooled part in contact with the coolant,
- wherein the mechanical refrigerator is coupled to one or each of the vacuum chamber and inner chamber through vibration-reducing couplings so as to reduce the effect upon the target apparatus of vibrations from the mechanical refrigerator.

Whilst the use of mechanical refrigerators to reduce coolant boil-off from cryostats is a relatively new development, we have realised that this has associated problems in that it causes vibrations which may affect apparatus within the cryostat itself by various mechanisms. The present invention recognises this problem and addresses it by the use of vibration-reducing couplings within the apparatus. These may take a number of forms although preferably the vibration-reducing couplings are resilient couplings.

In addition, the provision of at least one cooled part of the mechanical refrigerator being in actual contact with the coolant from within the inner chamber, allows for a high cooling efficiency and therefore direct cooling rather than providing an intermediate component with a high thermal conductivity to transmit the cooling effect. At least one cooled part of the mechanical refrigerator is in direct gaseous communication with the interior of the inner chamber such that the contacting part or parts share a common environment with the inner chamber interior. The gaseous communication is therefore provided by the coolant in gaseous form and the chamber is effectively open to the cooled part or parts, with these parts preferably being in the vicinity of the opening onto the inner chamber interior. Where multistage refrigerators are used, preferably at least the lowest temperature stage is cooled in this manner.

Typically the apparatus further comprises one or more radiation shields positioned between walls of the vacuum chamber and inner chamber.

It is of course practically advantageous to provide physical coupling between at least part of the mechanical refrigerator and the chambers and radiation shield(s), not only for providing sealed enclosed apparatus to preserve coolant but particularly since the radiation shields are often cooled to a low temperature. Wherever such coupling is used, preferably the invention provides for vibration-reducing couplings so as to dampen vibrations originating from the mechanical refrigerator when in use.

It will be appreciated that more than one coupling may be provided between the mechanical refrigerator and each of either chamber or radiation shield. Preferably each of such couplings is provided as a vibration-reducing coupling and most preferably, all couplings between the mechanical refrigerator and the chambers and radiation shields are provided as such couplings. The mechanical refrigerator is therefore preferably mechanically isolated in terms of vibrations from all cooling apparatus vessels and particularly the target apparatus within the inner chamber.

Various types of vibration-reducing coupling are envisaged in the present case. Preferably resilient couplings are used since they tend to provide good performance and return the apparatus to which they are coupled to a predetermined equilibrium position. One preferred coupling type takes the form of bellows which may be formed from a suitable material such as stainless steel. Bellows also provide an advantage in that, with an appropriate selection of materials (such as stainless steel), they can withstand a pressure differential across their surfaces. This makes bellows suitable for providing a barrier between parts experiencing a low pressure such as inside the vacuum chamber, and those at a relatively high ambient pressure (such as the external environment or inner chamber interior). The bellows therefore act effectively as walls of variable length separating regions at different operational pressures. Although various bellows designs can be used, preferably the bellows are formed from joined ring members. Other forms of resilient couplings include braided metallic wires such as braided copper for use in providing good thermal contact with components such as the radiation shields, and indeed various forms of spring, such as coiled springs or leaf springs. Compressible materials are also envisaged, although these tend to be less preferred at very low temperatures since they may become brittle.

It is desirable to effect couplings in the apparatus using various flanges since these provide surfaces which enable good contact over a relatively large area (advantageous for thermal conduction) and also for load bearing purposes. The apparatus therefore preferably comprises coupling flanges which are coupled with the vibration-reducing couplings and preferably the mechanical refrigerator also comprises one or more flanges for coupling to the coupling flanges.

In order to provide the vibration-reducing effect, the mechanical refrigerator preferably has a first refrigerator flange for coupling to a corresponding first coupling flange, and a second refrigerator flange located at a first cooled part of the refrigerator, for coupling to a corresponding second coupling flange. When the radiation shield(s) and/or the inner chamber is provided with corresponding vibration-reducing coupling(s) then the radiation shield(s) and/or inner chamber respectively is preferably coupled to the second coupling flange through the corresponding coupling(s). In this way, any vibrations propagating from the mechanical refrigerator to the second refrigerator flange are attenuated and preferably prevented from reaching the radiation shield (s) and/or the inner chamber.

The first and second flanges are typically spaced apart from each other and preferably a separating wall is also provided between the first and second flanges so as to separate the respective environments of the inner chamber and vacuum chamber. Advantageously, the separating wall may also be mechanically flexible so as to provide for variations in the spacing between the first and second flanges and in this case, the use of bellows as the separating wall provides further benefits in that any vibrations are also reduced.

The vacuum chamber may be provided with a corresponding vacuum chamber flange. The mechanical refrigerator is typically coupled to the vacuum chamber using a vibration-reducing coupling, preferably in the form of a resilient coupling. This may comprise a number of springs arranged to bear the forces generated by the weight of the mechanical refrigerator and/or the pressure difference between the interior and exterior of the vacuum chamber when in use. Typically in addition to the springs, the vacuum chamber flange is also coupled with a mechanical refrigerator through bellows in parallel with the spring so as to reduce vibrations and also to act as a separating wall between the vacuum chamber interior and the external environment.

The invention is applicable to one stage, two stage and multistage mechanical refrigerators. Typically a two stage device is used to attain sufficient cooling. This typically has a first stage cooled to a first temperature below ambient temperature and a second stage cooled to a second temperature lower than the first temperature. In a three stage device, a third stage is provided at a third temperature lower than the second temperature, and so on. In a two stage device the first stage is also preferably used to cool the radiation shield(s) and the second stage is preferably provided with a recondenser for condensing gaseous coolant from the inner chamber. This serves to recycle the coolant and allows the apparatus to be used for extended periods.

Various types of mechanical refrigerator may be used with the invention, these including Pulse tube, Stirling, Gifford-MacMahon and Joule-Thomson refrigerators. It has been found that pulse tube refrigerators are advantageous for low temperature applications, particularly using liquid helium within the inner chamber.

Preferably the mechanical refrigerator is removably mounted to the apparatus in a manner such that any vacuum in the vacuum chamber may be maintained upon removal of the mechanical refrigerator. The provision of the first and second refrigerator flanges, the first and second coupling flanges and the bellows acting as separating walls, conveniently provides this function.

It is extremely advantageous to allow the removal of the mechanical refrigerator since this allows maintenance of the refrigerator off-line and also the use of different refrigerator types with the same remainder of the apparatus. Further advantage is provided by the ability to remove the refrigerator and not affect the vacuum within the vacuum chamber since this allows the low temperature within the inner chamber to be maintained thereby reducing coolant loss and also reducing the system down-time.

The invention therefore allows the use of mechanical refrigerators to maintain the low coolant temperatures in apparatus such as cryostats whilst preventing vibrations from causing problems in the cooled apparatus. This allows the apparatus to be used for sensitive NMR experiments using cooled superconducting magnetics. The invention may also be used in the cooling of magnets for magnetic resonance imaging and other magnetic and non-magnetic low temperature procedures.

Figure 2:
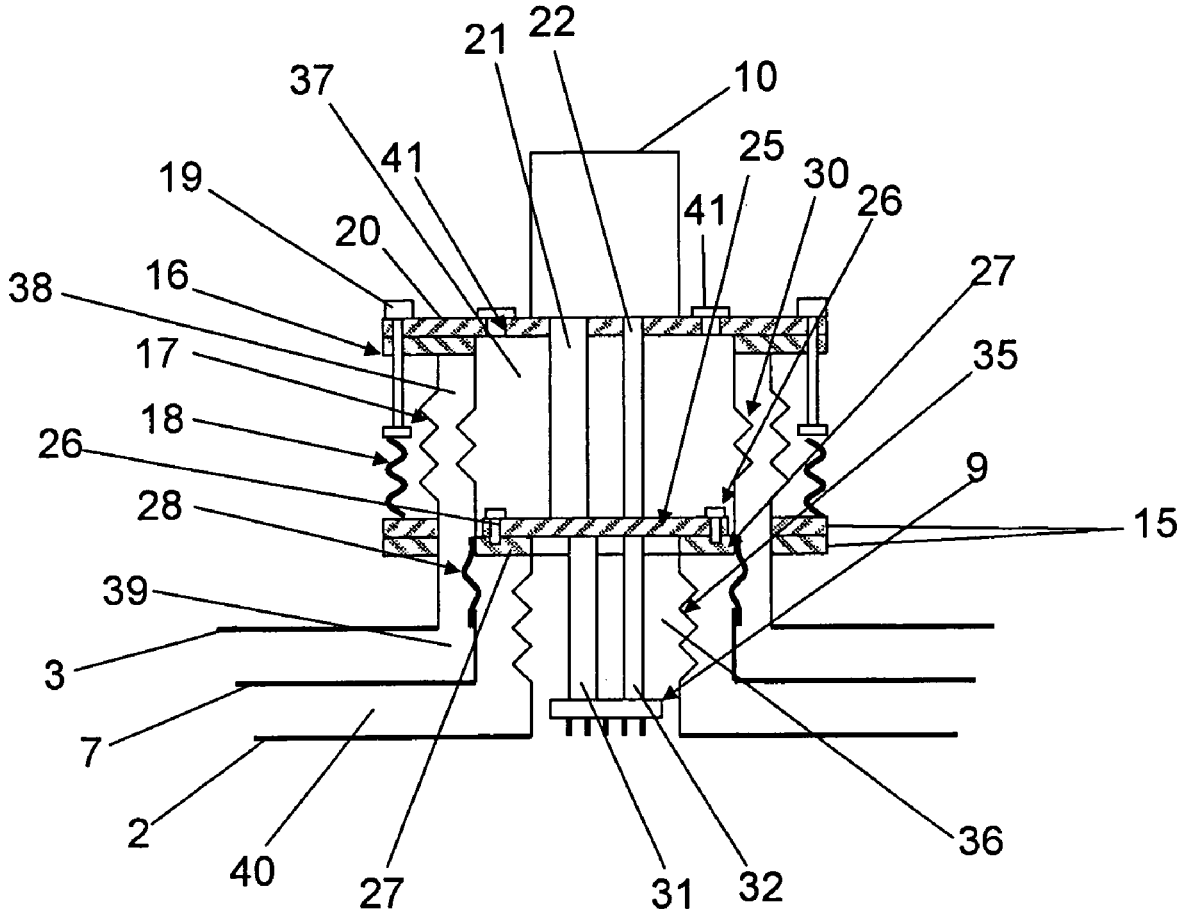

An example of apparatus according to the invention will now be described with reference to the accompanying drawings in which:

FIG. 1 is a schematic illustration of cooling apparatus according to the example; and FIG. 2 is a view, partly in section, showing how the mechanical refrigerator is mounted in the example.

FIG. 1 shows cooling apparatus generally indicated at 1, in this example the cooling apparatus taking the form of a cryostat. The cryostat has an inner chamber 2 which is positioned inside a vacuum chamber 3. The vacuum chamber 3 is evacuated in use, as is known, so as to provide good thermal insulation of the inner vacuum chamber from the external environment. In the present example, target apparatus 4 in the form of a superconducting magnet is positioned within the interior of the inner chamber 2. The magnet 4 is immersed in a liquid coolant 5, contained within the inner chamber 2. The coolant in this case is liquid helium having a temperature below 4.2 Kelvin.

Since the temperature of the external environment indicated at 6 may be of the order to 300 Kelvin, there is a large temperature difference between the external environment 6 and that of the coolant 5. For this reason, it is necessary to provide one or more cooled radiation shields, indicated at 7. If a single radiation shield is provided, then this is typically cooled to an intermediate temperature, for example 50 Kelvin, whereas if a plurality of shields are arranged concentrically, then a plurality of temperatures are used, with the inner shield having the lower temperature.

In many known cryostats, the coolant 5 gradually boils off, forming gaseous coolant 8 above the liquid coolant 5. This is vented to the external atmosphere. In the present example, however, a recondensing device 9 is provided, which is cooled below the boiling point of the helium coolant (4.2 Kelvin) and therefore returns at least some of the gaseous coolant back to the bath of coolant 5 by condensation and precipitation. The cooling of both the recondenser 9 and the radiation shield 7 in the present example is provided by a mechanical refrigerator 10 coupled to the cryostat. In this case a two stage pulse tube refrigerator is used as the mechanical refrigerator 10.

Turning now to FIG. 2, the manner in which the mechanical refrigerator 10 is coupled to the cryostat is shown in more detail. FIG. 2 shows the top of the cryostat where the two stage pulse tube refrigerator 10 is mounted. The vacuum chamber 3 has an opening in its top which is provided with a vacuum chamber flange 15. This takes the form of two rings of similar dimensions which are coupled together in use. Although a single thicker ring could be provided, the use of two separable rings is convenient for allowing access to the interior of the apparatus. The vacuum chamber flange 15 is positioned substantially horizontally at the top of the vacuum chamber 3.

Another flange, this being an upper turret flange 16 (first coupling flange) is located above the vacuum chamber flange 15 and is in the form of a ring that has approximately the same outer radius as the vacuum chamber flange 15, although the upper turret flange 16 has a smaller internal radius. The vacuum chamber 15 and upper turret 16 flanges are coupled together by a resilient coupling in the form of an upper turret bellows 17. This is approximately cylindrical having a variable length which is achieved by the angled walls of the bellows. The vacuum chamber flange 15 is mounted to the lower end of the bellows 17, and the upper turret flange 16 is mounted to the upper opposing end. The upper turret bellows are formed from a series of joined edge-welded ring members fabricated from a stainless steel material. The thickness of the stainless steel material (is this case about 0.2 mm) and the angle between the ring members determines the extent of the bellows resilience which resists both axial elongation and compression of the cylinder bellows. Preferably light resilience is provided as a trade off between mechanical strength and vibration-reduction.

The bellows and flanges produce an airtight seal capable of withstanding at least a pressure difference of 1 bar between the interior of the bellows cylinder and the exterior. The bellows 17 are mounted to the vacuum chamber flange 15 at the inner circumference of the flange. A number of springs 18 are also mounted to the upper surface of the vacuum chamber flange 15, these being distributed evenly and circumferentially around the flange 15 at a larger radius than that at which the bellows are attached. The springs 18 are connected to bolts 19 which pass through corresponding bolt holes in the upper turret flange 16 at a similar radial position.

The springs control the relative positions of the upper turret flange 16 and vacuum chamber flange 15. In use, they primarily take the load of a force due to the pressure differential across the upper turret flange, and the weight of the pulse tube refrigerator 10. The refrigerator 10 is connected to a PTR flange 20 (first refrigerator flange) which is generally in the form of a disc of approximately equal radius to the maximum radius of the upper turret flange 16. Since the mechanical refrigerator 10 is a pulse tube refrigerator, first stage regenerator and pulse tubes 21 and 22 respectively, pass through corresponding apertures near the centre of the PTR flange 20. As shown in FIG. 2, the bolts 19 pass through the corresponding threaded bolt holes in the PTR flange 20 to transmit the forces to the springs 18. Additional bolts (not shown) securely connect the lower PTR flange surface with the upper surface of the upper turret flange.

At the base of the first stage regenerator and pulse tubes 21, 22, and positioned approximately centrally at a location level with the vacuum chamber flange, a first stage flange 25 is provided, this taking the form of a disc and having a radius less than that of the vacuum chamber flange 15. An outer annular region only of the first stage flange 25 is bolted using bolts 26 to a 50 K turret flange 27 beneath, using blind bolt holes (not penetrating the 50 K turret flange). The 50 K turret flange (second coupling flange) is again in the form of a ring having an outer radius a little larger than that of the first stage flange 25 and yet smaller than that of the inner radius of the vacuum chamber flange 15, so as to provide a gap between them.

The first stage flange 25 is in intimate contact with a first cooled stage of the pulse tube refrigerator 10 and the bolting of this to the 50 K turret flange beneath provides good thermal contact between the flanges 25 and 27. As the name suggests, the 50 K turret flange, and indeed the bolts 26 and first stage flange 25 are all cooled to approximately 50 Kelvin by the first stage of the pulse tube refrigerator.

As is shown in FIG. 2, the radiation shield 7 is coupled to the 50 K turret flange at locations adjacent its outer circumference. This is achieved using twisted braided copper wires 28, these being provided with a meandering or zig-zag form rather than being purely linear. This form provides for the attenuation of any vibrations propagating from the 50 K turret flange towards the radiation shield 7. Since the first stage of the pulse tube and corresponding flanges is at approximately 50 Kelvin, it will be appreciated that the radiation shield 7 is cooled to approximately 50 Kelvin. The braided wires 28 therefore act as vibration reducing couplings, as does the upper turret bellows 17. The radiation shield 7 and braids 28 are positioned within the interior of the vacuum chamber 3 between the walls of that vacuum chamber and those of the inner chamber 2.

A second set of bellows, these being upper internal bellows 30, are provided extending axially between the outer circumference of the 50 K turret flange 27, and the inner circumference of the upper turret flange 16. The upper internal bellows 30 are therefore coaxial with the upper turret bellows 17, being of a similar form and material, although the internal bellows have a smaller radius. These also provide an airtight seal between the upper turret flange 16 and the 50 K turret flange such that a pressure difference between the exterior and interior of the upper internal bellows, of at least 1 bar, can be maintained.

At a position approximately at the centre of the first stage flange 25, second stage regenerator and pulse tubes 31 and 32 respectively pass downwards towards an opening at the top of the inner chamber 2. A second stage part of the pulse tube refrigerator 10 having an operating temperature below 4.2 Kelvin, is attached to the recondenser 9 positioned at the lower end of the tubes 31, 32. This causes the condensation of gaseous helium 8 (see FIG. 1), the condensed helium then dripping back into the bath of liquid helium coolant 5. The opening at the top of the inner chamber 2 is also provided with bottom internal bellows 35, these again being in the form of a cylinder made from stainless steel ring sections. The upper end of the lower internal bellows is coupled with an internal circumference of the 50 K turret flange, whereas the lower end is coupled with the opening of the inner chamber 2. This provides for an airtight seal, again capable of withstanding a pressure difference of 1 bar between the internal and external parts of the lower bellows and vibration reduction.

It should be noted in FIG. 2 that the volumes shown at 36 and 37, defining the spaces around the first and second stage tubes, are effectively a single connected volume since apertures are provided to allow gaseous coolant to move between the volumes 36, 37 freely. These are therefore at the same pressure as the inside of the inner chamber 2. Typically this pressure is 1 bar (absolute). Due to the sealing effect of the bellows and flanges, it will be noted that the vacuum chamber 3 when in use, provides a similar low pressure on both the exterior and interior of the radiation shield 7 as indicated at 39 and 40. In addition, a similar low pressure is experienced between the bellows 17 and 30 in the approximately cylindrical concentric section between them. In the region of the springs 26 and bolts 19, the apparatus is at ambient pressure.

When in use, the pulse tube refrigerator 10 produces vibrations which propagate through the PTR flange 20 and down the first stage regenerator and pulse tubes 21, 22. Because the PTR flange 20 is mounted to the upper turret flange 16, this flange 16 is also vibrated by the operation of the pulse tube refrigerator. However, the springs 18 and upper turret bellows 17 serve to significantly attenuate these vibrations so as to prevent them from propagating to the vacuum chamber flange 15. This is desirable since the vacuum chamber flange 15 is directly connected to the vacuum chamber and any vibration within the vacuum chamber may cause disturbances in the magnetic field produced by the superconducting magnet (for NMR in this case) which forms the target apparatus 4 in this example.

Some reduction of vibrations is also provided by the upper internal bellows 30 although primarily the bellows are used in this case to allow ease of mounting of the PTR flange 20 to the upper turret flange 16 since thermal expansions and contractions cause variations in the dimensions of the apparatus.

The first stage flange, 50 K turret flange and bolts 26 each also suffer vibrations from the pulse tube refrigerator 10 which propagate down the regenerator and pulse tubes 21, 22. In order to prevent these reaching the 50 K shield, the copper braided wires 28 are provided which dampen the vibrations and provide the conductive cooling required. Since the shield 7 also typically comprises a large metallic component, it is desirable to prevent vibrations of this component within the magnetic field.

The lower internal bellows 35 act so as to attenuate the propagation of vibrations to the inner chamber 2. This is particularly important since vibrations in the inner chamber 2 would not only cause a disturbance in the magnetic field for the target apparatus 4 but would also directly couple to the apparatus.

Through the use of springs, bellows and braided wires, it can be seen that the pulse tube refrigerator 10 can be effectively isolated in terms of vibrations from each of the vacuum chamber, inner chamber and radiation shields.

Great advantage is also provided by the arrangement as shown in FIGS. 1 and 2 since the pulse tube refrigerator 10 can be removed from the system without affecting the vacuum within the vacuum chamber. To remove the pulse tube refrigerator, the bolts 26 must be undone and this is achieved by passing a suitable tool through access ports 41 into the volume 37 at atmospheric pressure. The removal of the bolts 26 allows for the de-coupling of the first stage flange 25 from the annular 50 K turret flange 27 beneath. Similarly, the bolts 19 and additional bolts may be removed to allow the separation of the PTR flange 20 from the upper turret flange beneath. The entire pulse tube refrigerator 10, together with the PTR flange 20, first stage tubes 21, 22, flange 25, second stage tubes 31, 32 and recondenser 9 can all therefore be removed as a unit. This allows for off-line servicing of the pulse tube refrigerator 10 or replacement with a similar or different mechanical refrigerator 10, for example for use at a different operational temperature, or with a different coolant. Once the pulse tube refrigerator has been removed, the inner chamber is then open to the external environment and therefore this may be capped off with a disc-type flange in place of the PTR flange, together with baffles to allow the coolant to boil off slowly until another mechanical refrigerator is coupled to the cryostat.

We claim:

1. Cooling apparatus for cooling a target apparatus, comprising:

a vacuum chamber;

an inner chamber positioned within the vacuum chamber and adapted in use to contain a coolant for cooling the target apparatus within the interior of the inner chamber; and a mechanical refrigerator for refrigerating the coolant and having at least one cooled part in contact with the coolant, wherein the mechanical refrigerator is coupled to at least one of the vacuum chamber and the inner chamber only through vibration-reducing couplings so as to reduce the effect of vibrations from the mechanical refrigerator upon the target apparatus, the at least one cooled part is in gaseous communication with the interior of the inner chamber such that the at least one cooled part in contact with the coolant shares a common pressure environment with the inner chamber interior, and each cooled part of the mechanical refrigerator is in gaseous communication with the interior of the inner chamber.

2. Cooling apparatus according to claim 1, further comprising one or more radiation shields positioned between walls of the vacuum chamber and inner chamber.

3. Cooling apparatus according to claim 2, wherein each coupling between the mechanical refrigerator and at least one of the vacuum chamber, radiation shield(s) or inner chamber is a vibration-reducing coupling.

4. Cooling apparatus according to claim 2, wherein each of the vacuum chamber, radiation shield(s) and inner chamber are coupled to the cooling apparatus using vibration-reducing couplings.

5. Cooling apparatus according to claim 1, wherein the vibration-reducing coupling(s) are resilient coupling(s).

6. Cooling apparatus according to claim 5, wherein the resilient coupling(s) comprise bellows.

7. Cooling apparatus according to claim 6, wherein the bellows act as walls of variable length separating regions at different operational pressures.

8. Cooling apparatus according to claim 6, wherein the bellows are formed from stainless steel.

9. Cooling apparatus according to claim 6, wherein the bellows comprise joined ring members.

10. Cooling apparatus according to claim 2, wherein, when one or more vibration-reducing couplings are provided to the radiation shield(s), the couplings comprise braided thermally conducting wires.

11. Cooling apparatus according to claim 2, wherein one or more coupling flanges are provided for coupling the vibration-reducing couplings to other components.

12. Cooling apparatus according to claim 11, wherein the mechanical refrigerator further comprises one or more flanges for coupling to the coupling flanges.

13. Cooling apparatus according to claim 12, wherein the mechanical refrigerator has a first refrigerator flange for coupling to a corresponding first coupling flange and a second refrigerator flange located at a first cooled part of the refrigerator for coupling to a corresponding second coupling flange.

14. Cooling apparatus according to claim 13, wherein, when the radiation shield(s) is provided with a corresponding vibration-reducing coupling, the radiation shield(s) is coupled to the second coupling flange through the coupling.

15. Cooling apparatus according to claim 13, wherein, when the inner chamber is provided with a corresponding vibration-reducing coupling, the inner chamber is coupled to the second coupling flange through the coupling.

16. Cooling apparatus according to claim 13, wherein a separating wall is provided between the first and second flanges so as to separate the respective environments of the inner chamber and vacuum chamber.

17. Cooling apparatus according to claim 16, wherein the separating wall comprises bellows.

18. Cooling apparatus according to claim 13, wherein the vacuum chamber is provided with a corresponding vacuum chamber flange.

19. Cooling apparatus according to claim 13, wherein a separating wall is provided between the first and vacuum flanges so as to separate the vacuum chamber environment from the external environment.

20. Cooling apparatus according to claim 19, wherein when a vibration-reducing coupling is provided between the mechanical refrigerator and the vacuum chamber, the separating wall comprises the coupling.

21. Cooling apparatus according to claim 20, wherein the separating wall coupling is a resilient coupling in the form of bellows.

22. Cooling apparatus according to claim 18, wherein when the mechanical refrigerator is coupled to the vacuum chamber flange through a vibration-reducing coupling, the coupling comprises a spring arranged to bear the forces generated by the weight of the mechanical refrigerator and/or the pressure difference between the interior and exterior of the vacuum chamber when in use.

23. Cooling apparatus according to claim 1, wherein the mechanical refrigerator comprises a plurality of cooled stages.

24. Cooling apparatus for cooling a target apparatus, comprising:

a vacuum chamber:

an inner chamber positioned within the vacuum chamber and adapted in use to contain a coolant for cooling the target apparatus within the interior of the inner chamber; and a mechanical refrigerator for refrigerating the coolant and having at least one cooled part in contact with the coolant, wherein the mechanical refrigerator is coupled to at least one of the vacuum chamber and the inner chamber only through vibration-reducing couplings so as to reduce the effect of vibrations from the mechanical refrigerator upon the target apparatus, the at least one cooled part is in gaseous communication with the interior of the inner chamber such that the at least one cooled part in contact with the coolant shares a common pressure environment with the inner chamber interior, the mechanical refrigerator comprises a plurality of cooled stages, and each cooled stage is in contact with the coolant.

25. Cooling apparatus according to claim 2, wherein the mechanical refrigerator is a two stage device having a first stage cooled to a first temperature below ambient temperature and a second stage cooled to a second temperature lower than the first temperature.

26. Cooling apparatus according to claim 25, wherein the first stage is used to cool the radiation shield(s).

27. Cooling apparatus for cooling a target apparatus, comprising:

a vacuum chamber;

an inner chamber positioned within the vacuum chamber and adapted in use to contain a coolant for cooling the target apparatus within the interior of the inner chamber;

a mechanical refrigerator for refrigerating the coolant and having at least one cooled part in contact with the coolant; and one or more radiation shields positioned between walls of the vacuum chamber and inner chamber, wherein the mechanical refrigerator is coupled to at least one of the vacuum chamber and the inner chamber only through vibration-reducing couplings so as to reduce the effect of vibrations from the mechanical refrigerator upon the target apparatus, the at least one cooled part is in gaseous communication with the interior of the inner chamber such that the at least one cooled part in contact with the coolant shares a common pressure environment with the inner chamber interior, the mechanical refrigerator is a two stage device having a first stage cooled to a first temperature below ambient temperature and a second stage cooled to a second temperature lower than the first temperature, and each cooled stage is arranged in a common pressure environment with the inner chamber.

28. Cooling apparatus according to claim 27, wherein the mechanical refrigerator is a pulse tube refrigerator.

29. Cooling apparatus according to claim 28, wherein a regenerator and/or pulse tubes separating the cooling stages are also in a common pressure environment with the interior of the inner chamber.

30. Cooling apparatus according to claim 1, wherein the mechanical refrigerator is removably mounted to the target apparatus such that any vacuum within the vacuum chamber is maintained upon removal of the mechanical refrigerator.

31. Cooling apparatus according to claim 13, wherein the first and the second refrigerator flanges are mounted to and are removably with the mechanical refrigerator.

32. Cooling apparatus according to claim 25, wherein the second cooled stage is used to cool a recondenser for condensing gaseous coolant from the inner chamber.

* * * * *